US007367408B2

(12) United States Patent
Moyna

(10) Patent No.: US 7,367,408 B2
(45) Date of Patent: May 6, 2008

(54) SCRAPING DEVICE AND A SYSTEM AND A METHOD FOR COLLECTING MATERIALS

(75) Inventor: John P. Moyna, Elkader, IA (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/586,960

(22) Filed: Oct. 27, 2006

(65) Prior Publication Data

US 2007/0039212 A1 Feb. 22, 2007

Related U.S. Application Data

(62) Division of application No. 11/352,977, filed on Feb. 13, 2006, now Pat. No. 7,356,949, which is a division of application No. 11/141,168, filed on May 31, 2005, now Pat. No. 7,117,953, which is a division of application No. 10/377,567, filed on Feb. 27, 2003, now Pat. No. 6,910,289.

(51) Int. Cl.

| | |
|---|---|
| ***A01B 15/00*** | (2006.01) |
| ***A01B 23/00*** | (2006.01) |
| ***E02F 3/12*** | (2006.01) |
| ***E02F 3/64*** | (2006.01) |
| ***E02F 3/76*** | (2006.01) |

(52) U.S. Cl. ..... 172/777; 172/799.5; 172/684.5; 37/268; 37/271

(58) Field of Classification Search ..... 172/777–799.5, 172/810–834, 684.5; 37/266–284
See application file for complete search history.

(56) References Cited

U.S. PATENT DOCUMENTS

| | | | |
|---|---|---|---|
| 2,131,947 | A | 10/1938 | Gilmore |
| 2,312,471 | A | 3/1943 | Low |
| 3,040,638 | A | 6/1962 | Atkinson |
| 3,099,191 | A | 7/1963 | Averette |
| 3,358,569 | A | 12/1967 | Averette |
| 4,723,870 | A | 2/1988 | Martinez |
| 4,823,421 | A | 4/1989 | Kleynjans et al. |

(Continued)

FOREIGN PATENT DOCUMENTS

DE 3277965 A1 * 2/1988

OTHER PUBLICATIONS

Derwent 1996-279577, Jan. 1996.*

(Continued)

*Primary Examiner*—Christopher J. Novosad

(57) ABSTRACT

A scraping device, a system and a method for collecting a material are provided. The scraping device may have a bowl having a first end and a second end. A lip may be positioned at the first end and may cover an opening at the first end. In an embodiment, direct mounted cylinders may be attached to the lip and may move the lip to completely cover or uncover the opening. The scraping device may have a tongue mounted to the bowl having a triangular-shaped plate mechanism that may be used to raise and to lower a cutting edge attached to the bowl. Cylinders connected to the mechanism may be retracted or extended to raise or to lower the scraping device. A load within the scraping device may be lifted by force exerted from a barrel end of a cylinder, thus utilizing a maximum potential of the cylinder.

9 Claims, 7 Drawing Sheets

U.S. PATENT DOCUMENTS 4,950,102 A 8/1990 Zeitz
5,452,489 A 9/1995 Gelder et al.
5,460,460 A 10/1995 Alexander
5,501,058 A * 3/1996 Sonoyama et al. ..... 53/204
5,531,283 A 7/1996 Austin et al.
5,728,327 A * 3/1998 Borcoman et al. ..... 264/39
6,347,670 B1 2/2002 Miskin
6,360,393 B1 3/2002 Fritz

OTHER PUBLICATIONS

Derwent 1983-820642, Jan. 1983.*

* cited by examiner

SCRAPING DEVICE AND A SYSTEM AND A METHOD FOR COLLECTING MATERIALS

This application is a divisional application of U.S. patent application Ser. No. 11/352,977 filed on Feb. 13, 2006 which is a divisional application of U.S. patent application Ser. No. 11/141,168 filed on May 31, 2005 which issued as U.S. Pat. No. 7,117,953 on Oct. 10, 2006 which is a divisional application of U.S. patent application Ser. No. 10/377,567 filed on Feb. 27, 2003 which issued as U.S. Pat. No. 6,910,289 on Jun. 28, 2005.

BACKGROUND OF THE INVENTION

The present invention generally relates to a scraping device and a system and a method for collecting a material. The scraping device may have a frame or bowl in which material is collected. The bowl may have a lip which prevents material from falling from the bowl. A first cylinder may be associated with the lip wherein a motion through which the first cylinder moves the lip is compact and efficient. Less effort may be required by the first cylinder to move the lip, and less fluid may be required to move the cylinder, than required in cylinders in known scraping devices. In addition, the scraping device may have plates attached to the frame. The plates may be pivotally attached at a first end and connected by a second cylinder at a second end, forming, for example, a triangular-shaped mechanism. Extension or retraction of the cylinder may cause the scraping device to move closer to or further away from the material to be collected. Accordingly, the scraping device of the present invention may enable efficient collection and/or transferral of materials.

Of course, construction of new roads and existing roads is required throughout the country and around the world to expedite travel for trucks, automobiles and the like. An area must be pre-treated to create a surface that is suitable for paving. If the area to be paved has soil, the soil may be broken prior to compaction or other processes. The soil may also be collected and moved to a different location.

Breaking and collection of the soil is typically performed with a scraper pulled behind, for example, a tractor. A known scraper has a frame having a bowl shape and a lip which serves as a wall to prevent soil or other materials from leaving the bowl. The lip is raised by a cylinder to allow collected material to exit the bowl. A blade is attached near the bottom of the bowl and below the lip. As the scraper is moved across an area of soil to be broken, the blade of the scraper may press into the soil, and the soil may be collected within the bowl. The lip is then lowered to prevent the material from exiting the bowl during transport of the material to another area. When the material is removed from the bowl, the cylinder raises the lip, leaving an open area in the bowl to allow removal of the material from the scraper.

In the past, many different types of scrapers have been built, including pull-scrapers, motor scrapers, twin-engine scrapers, paddle wheel scrapers, and auger scrapers. As these devices were built, their ability to raise and to lower their loads has always been somewhat inefficient because many models needed excess weight to hold themselves together structurally. This weight was in the form of a massive spreader tube and the need for draft arms to raise and to lower the load. Many scrapers incorporate massive cylinders to raise and lower the load because, with their design, they lift their loads with a rod end of a cylinder in contrast to a barrel end. As a result, a need was created for a lighter scraper that also has better hydraulic efficiency with respect to smoothness and quickness of scraper operation.

To retain loads inside the scraper bowl, a movable lip was needed. This lip needed to be adjustable for varying soils from rock to clay to gravels and sands. Many lip designs have been tried with scraper bowls. Presently, lip designs are inefficient from the aspect of being able to open a lip one hundred percent for loading and closing one hundred percent for retaining granular materials. Current lips also have many linkages that add costs to the maintenance of the scrapers. The current lip system also adds needless weight.

In addition, many scrapers have areas that become worn and are costly for the user to maintain. One of several areas is a hitch area. Another area is a roller mechanism that contacts an ejector alignment. The roller mechanism may be subject to wear on a rear track, or an upper side guide system. Specifically, steel rollers, incorporated in the roller mechanism may, contact steel tracks and cause wear to the roller mechanism. Replacement of the steel rollers and the steel tracks may become expensive.

Accordingly, a need has been created for a scraping device that functions in a reliable and efficient manner while keeping the cost of equipment, as well as scraping costs, affordable. Moreover, a need exists for a scraping device and a system and a method for collecting a material wherein the scraping device may lower the cost per ton and/or cost per yard for earthmovers as well as provide efficient collection and/or removal of materials.

SUMMARY OF THE INVENTION

The present invention provides a scraping device and a system and a method for collecting a material, such as, for example, soil, stone, sand, or the like. The scraping device may have a frame having a first end and a second end. A lip may be positioned at the first end and may cover an opening at the first end. The lip may be connected to a cylinder which may be attached to the frame. The cylinder may be positioned wherein a full potential of the cylinder is used to raise or to lower the lip. As a result, less fluid may be required to move the cylinder, and collection of materials may be performed efficiently.

In addition, the scraping device may have a tongue connected to the frame. A first end of the tongue may be connected to, for example, a tractor. An opposite end may be connected to the frame. Connected to the tongue may be a raising and lowering mechanism that incorporates plates on opposite sides of the tongue. The mechanism may require additional plates attached to the frame. Cylinders may connect the plates adjacent the tongue to the plates attached to the frame in, for example, a triangular arrangement. The triangular-shaped arrangement between the plates and cylinders may provide the scraping device with a pulling force in a direct line to a cutting edge of a blade attached to the frame.

Attaching the plates to the tongue, frame and cylinders in the triangular arrangement may eliminate a need for extra materials in the construction of the scraping device, such as, for example, draft arms. Accordingly, the scraping device may have a reduced weight while maintaining durability. When the scraping device is loaded, a greatest amount of hydraulic power is needed to lift the load. A barrel end of a cylinder may be used to raise and/or to lower a loaded scraping device, thus utilizing a maximum potential of the cylinder and/or providing the scraping device with hydraulic efficiency. Further, the triangular-shaped arrangement may maximize a weight and horsepower ratio. In addition, the triangular-shaped arrangement may allow the scraping device to be push-loaded.

Further, the scraping device of the present invention may not incorporate draft arms which are normally incorporated in known scraping devices. In contrast, the scraping device of the present invention may raise and/or lower a lip connected to the frame with direct mount cylinders. A need for linkages to raise and/or lower the lip may then be eliminated. The cylinder which may be used to raise and/or lower the lip may be direct mounted on a bowl portion of the frame. The lip may then be completely opened and/or closed without repositioning pins or using linkages. Accordingly, a maximum hydraulic power of the cylinder may be used and may enable downsizing of cylinders used to raise and/or lower the lip. This feature may enable effective movement of the lip for load retention and lip opening, and may also provide greater productivity during scraping.

Further, the scraping device of the present invention may eliminate wear in a hitch connected to the frame. Normally, the hitch may experience a substantial amount of wear. In the present invention, a size of the hitch may be increased in comparison to hitches used with known scrapers. In addition, a liner may be placed within the hitch. The liner may be constructed from, for example, a plastic or like material. The liner may absorb a force from a vertical load as the scraping device turns. By incorporating a liner between, for example, metal parts used to construct the hitch, an operating cost may be reduced for the hitch. Moreover, the hitch utilized in the scraping device enables the scraping device to be pushed to effect movement of the scraping device and/or scraping.

In addition, the scraping device of the present invention may have guides placed within a roller mechanism. The guides may be constructed from, for example, plastic or like material. In an embodiment, the plastic guides may be used in place of rollers for an ejector. A contact surface between the guides and a metal material used to construct a guide rail may provide efficient guiding of the ejector system. Further, use of the guides may reduce a replacement cost for the guide roller mechanism.

To this end, in an embodiment of the present invention, a scraping device is provided. The scraping device has a frame having walls defining an interior wherein the walls have an interior surface and further wherein the frame has a length defined between a first end and a second end. The scraping device also has a plate at the first end of the frame. A first cylinder is attached to the plate wherein movement of the cylinder causes the plate to move towards the second end of the frame. In addition, the scraping device has a lip having walls defining an interior wherein the walls have an exterior surface which is connected to the interior surface of opposing walls of the frame at a single point on each of the opposing walls of the frame wherein the lip pivots at the points. A second cylinder is attached to the exterior surface of the lip wherein movement of the second cylinder moves the lip.

In an embodiment, the scraping device has a hitch connected to the frame.

In an embodiment, the scraping device has wheels connected to the frame.

In an embodiment, the scraping device has a blade attached to the frame.

In an embodiment, the scraping device has beams connected to the plate and tracks connected to the frame wherein the beams are guided by the tracks.

In an embodiment, the scraping device has a third cylinder attached to the lip.

In an embodiment, the scraping device has a fourth cylinder attached to the second end of the frame wherein the fourth cylinder moves the frame.

In an embodiment, the scraping device has wheels connected to the plate.

In another embodiment of the present invention, a system is provided for collecting a material. The system has a scraping device having a frame having an interior surface. The system also has a hitch connected to the scraping device wherein the hitch has a beam having a body defined between a first end and a second end. The hitch further has a first column attached to the first end of the hitch. The first column has a top surface and a bottom surface and a body defined between a first end and a second end wherein the first column rotates along a first axis. The hitch further has a second column attached to the bottom surface of the first column wherein the second column has a body defined between a first end and a second end and wherein the second column rotates along a second axis wherein the first axis and the second axis are different and wherein a pillar is positioned between the top surface of the first column and the scraping device wherein the pillar rotates along a third axis wherein the third axis is different from the first axis and the second axis.

In an embodiment, the system has a liner positioned between the first column and the scraping device.

In an embodiment, the system has a lip pivotally attached to the interior surface of the frame wherein the lip has walls defining an interior.

In an embodiment, the system has a plate associated with the frame wherein the plate is moved to force the material from the frame.

In an embodiment, the system has wheels connected to the frame.

In an embodiment, the system has a blade attached to the frame.

In an embodiment, the system has a liner positioned between the top surface of the first column and the beam.

In an embodiment, the system has a guard attached to the frame wherein the guard has a body defined by a plane.

In an embodiment, the system has plates pivotally connected to the beam and the frame wherein movement of the plates moves the frame toward the material.

In another embodiment of the present invention, a method is provided for collecting a material. The method comprises the steps of providing a scraping device having a frame having walls defining an interior wherein the walls have an interior surface and wherein the frame has a length defined between a first end and a second end wherein an opening exists at the first end and wherein the scraping device further has a lip connected to the first end of the frame which is raised to uncover the opening at the first end and further wherein a cylinder is attached to the walls and further attached to a side of the lip wherein movement of the cylinder raises the lip and further wherein the scraping device has a blade attached to the frame and wherein the scraping device has a plate positioned at the second end of the frame; adjusting an angle of the scraping device wherein the blade is angled toward an area having the material; and moving the scraping device across the area.

In an embodiment, the method further has the step of moving the cylinder to lower the lip to cover the opening at the first end of the frame.

In an embodiment, the method further has the step of moving the plate to force the material through the opening in the first end.

In another embodiment of the present invention, a scraping device is provided. The scraping device has a frame having a length defined between a first end and a second end. The scraping device also has a tongue extending from the first end of the frame wherein the tongue has a length defined between a first end and a second end wherein the tongue has a top surface and a bottom surface and wherein the tongue is pivotally connected to the frame. The scraping device further has first plates connected to the tongue wherein the plates are connected adjacent to the top surface of the tongue and connected adjacent to the bottom surface of the tongue. Second plates are attached to the frame and connected to the first plates adjacent to the bottom surface of the tongue. In addition, a cylinder is connected to one of the first plates adjacent to the top surface of the tongue and connected to one of the second plates.

In an embodiment, the scraping device has a hitch connected to the tongue.

In an embodiment, the scraping device has a lip connected to the frame wherein the lip has a body defined by a plane.

In an embodiment, the scraping device has tires connected to the frame.

In an embodiment, the scraping device has a second cylinder connected to one of the first plates and one of the second plates.

In an embodiment, the scraping device has a blade attached to the frame.

In another embodiment of the present invention, a scraping device is provided. The scraping device has a frame having walls defining an interior and further having a length defined between a first end and a second end. The scraping device also has a plate at the first end of the frame. The scraping device further has a cylinder attached to the plate wherein movement of the cylinder causes the plate to move towards the second end of the frame. Beams are connected to the plate. In addition, guide rails are connected to the frame wherein the guide rails are adjacent to the beams. Also provided is a liner positioned between the guide rails and the beams.

In an embodiment, the scraping device has a lip attached to the frame at the second end.

In an embodiment, the scraping device has a mounting bracket attached to the plate; and a liner positioned between the mounting bracket and a wall of the frame.

In an embodiment, the scraping device has a hitch attached to the frame.

In an embodiment, the scraping device has a blade attached at the second end of the frame.

It is, therefore, an advantage of the present invention to provide a scraping device, a system and a method for collecting a material.

Another advantage of the present invention is to provide a scraping device, a system and a method for collecting a material which enables breaking of an area to be constructed prior to compaction or other related process.

Yet another advantage of the present invention is to provide a scraping device, a system and a method for collecting a material which enables a cylinder, in association with a lip of the scraping device, to move the lip while utilizing a maximum potential of the cylinder.

Still another advantage of the present invention is to provide a scraping device, a system and a method for collecting a material which enables a cylinder to be used with the scraping device wherein a reduced amount of fluid is required to effect movement of the cylinder.

A further advantage of the present invention is to provide a scraping device, a system and a method for collecting a material which has a hitch which may be rotated in more than one axis of movement.

Yet another advantage of the present invention is to provide a scraping device, a system and a method for collecting a material which prevents material collected within the scraping device from falling from the scraping device.

A still further advantage of the present invention is to provide a scraping device, a system and a method for collecting a material which utilizes a liner between beams connected to an ejector blade, and tracks used to guide the beams, to prevent wear between the beams and the tracks.

Moreover, an advantage of the present invention is to provide a scraping device, a system and a method for collecting a material which utilizes a liner between columns associated with a hitch to prevent deterioration of the hitch.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a scraping device and a system and a method for collecting a material, such as, for example, soil, stone, sand, or the like. The scraping device may have a frame having a bowl-like shape. A lip may be positioned at a first end of the frame and may cover an opening at the first end. A plate may be positioned at a second end of the frame. The plate may be connected to a cylinder wherein movement of the cylinder moves the plate toward the lip and displaces collected materials from the frame through the opening.

The lip may be raised or lowered by a cylinder which may be connected at a side of the lip. The cylinder may also be connected to the frame. Connection of the cylinder to the lip and the frame may utilize a full potential of the cylinder when the cylinder moves the lip. As a result, less fluid may be required to move the cylinder, and collection of materials may be performed more efficiently.

Figure 1:
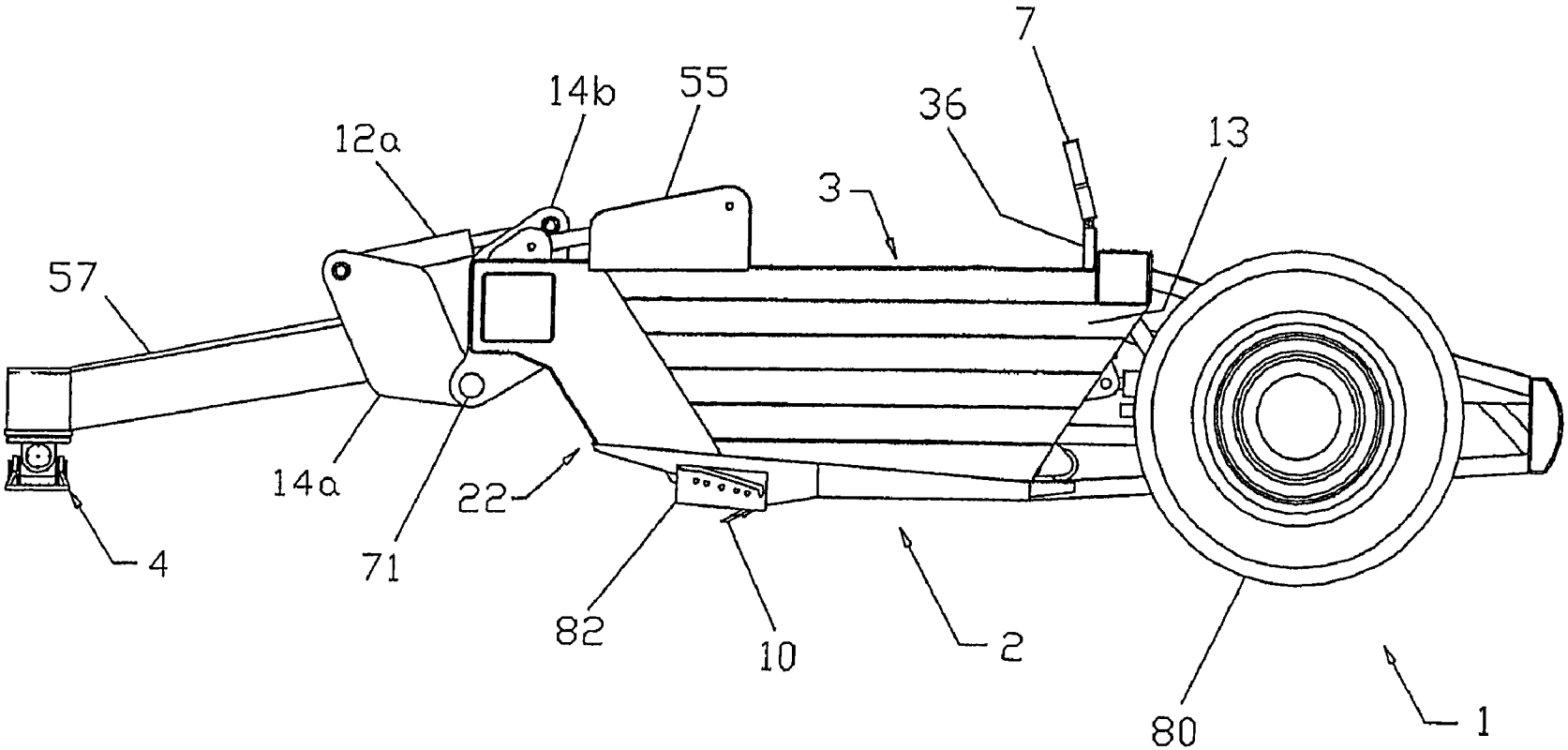
FIG. 1 illustrates a side view of a scraping device in an embodiment of the present invention.

Referring now to the drawings wherein like numerals refer to like parts, FIG. 1 illustrates a scraping device 1 in an embodiment of the present invention. The scraping device 1 may have a bowl 2 or frame having walls 13 defining an interior 3 into which materials may be collected and/or transported (described in further detail below). A blade 10 may be attached to the bowl 2 at an end 22. Adjacent to the blade 10 may be a router bit 82 which may assist in cutting into materials and may prevent the materials from causing wear to the scraping device 1.

Figure 3:
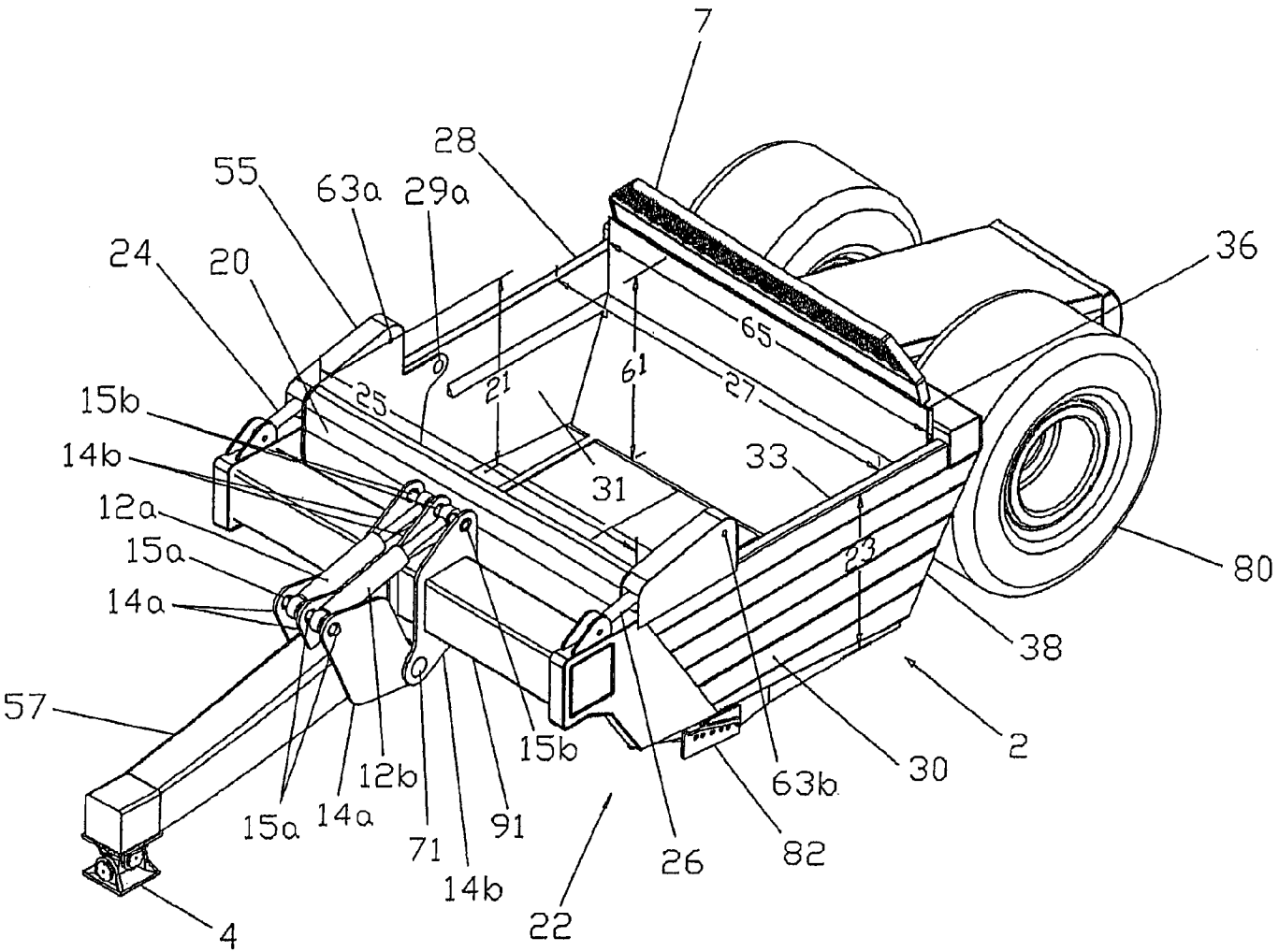
FIG. 3 illustrates a perspective view of an embodiment of the scraping device of FIG. 1.

FIG. 3 illustrates an elevated view of the bowl 2. A lip 20 may be attached to the bowl 2 at the end 22 of the bowl 2. The lip 20 may be sized wherein a height 21 of the lip 20 is substantially the same or greater than a height 23 of the bowl 2. A width 25 of the lip 20 may be substantially the same or less than a width 27 of the bowl 2. The size of the lip 20 may prevent materials within the bowl 2 from falling from an opening (not shown) at the end 22 of the bowl 2.

The lip 20 may be pivotally connected to the bowl 2 at points 29*a*, 29*b* on sides 28, 30, respectively, of the lip 20. Cylinders 24, 26 may be attached to the lip 20 on the sides 28, 30 at points 63*a*, 63*b*. The cylinders 24, 26 may be partially shielded by flaps 55 that may be attached to the lip 20. In an embodiment, the lip 20 may be pivotally attached to the sides 28, 30 of the bowl 2 by, for example, pins (not shown) inserted at points 29*a*, 29*b*. The cylinders may be attached to the bowl 2 at the end 22 of the bowl 2. The cylinders 24, 26 may be hydraulic and may use a hydraulic fluid to effect movement of the cylinders 24, 26.

Figure 2A:
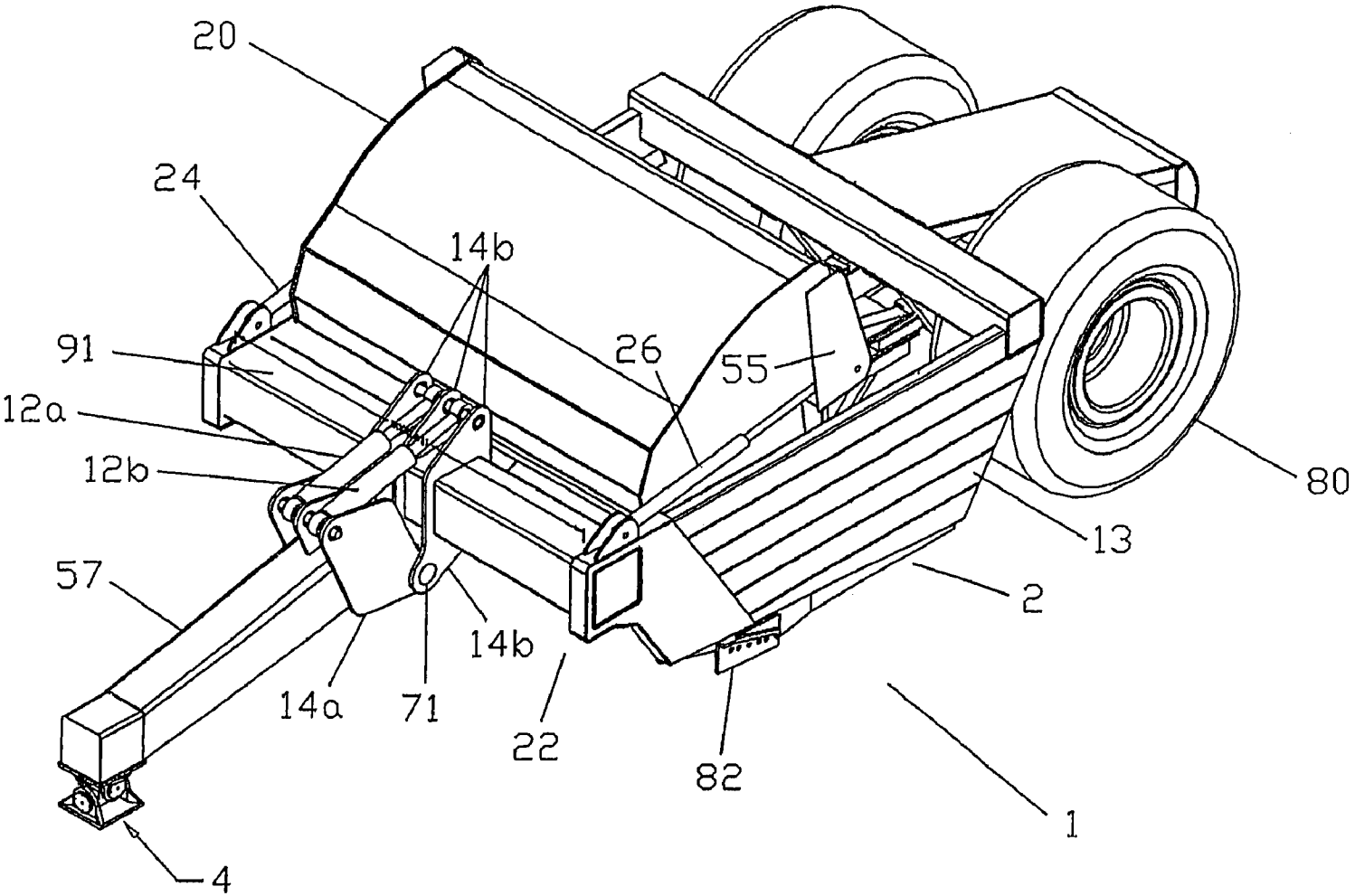
FIG. 2A illustrates a perspective view of an embodiment of the scraping device of FIG. 1.
Figure 2B:
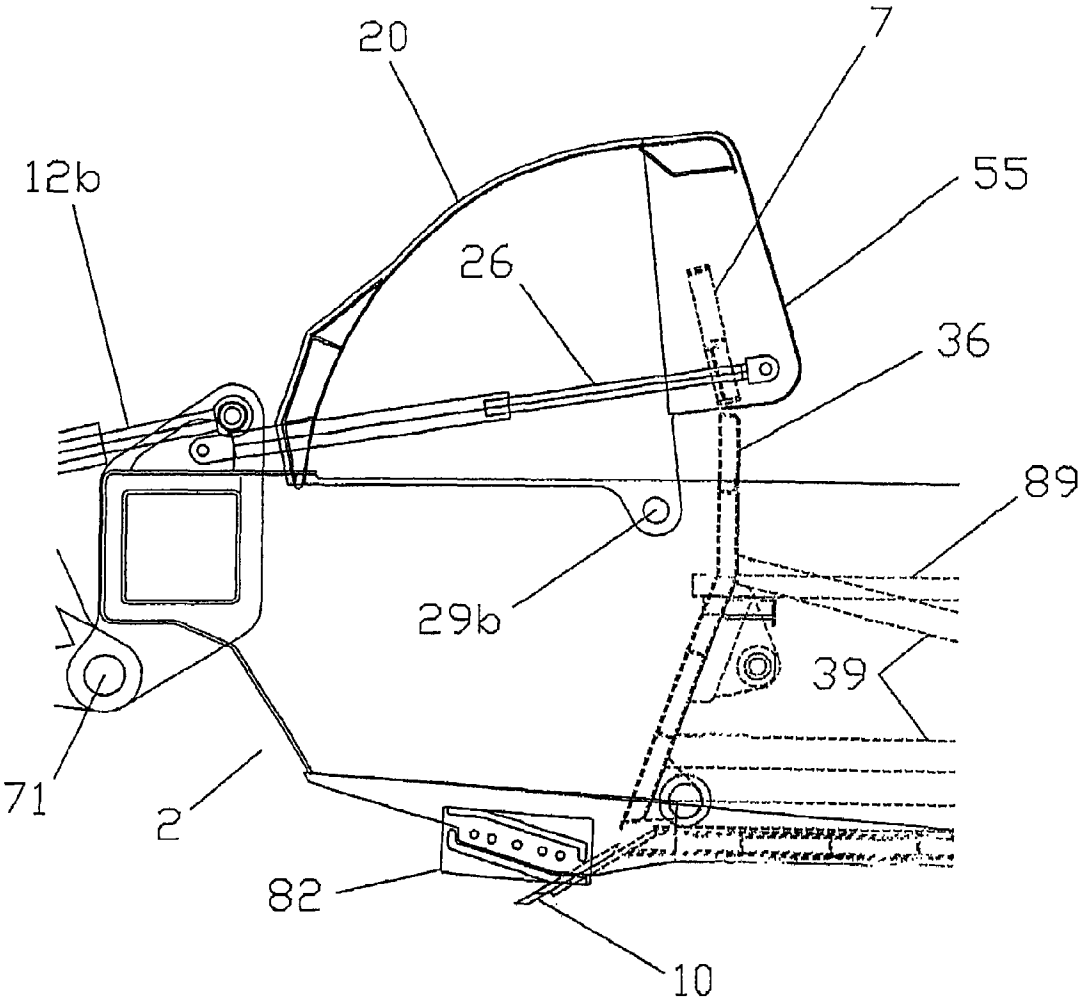
FIG. 2B illustrates a partial side view of an embodiment of the scraping device of FIG. 1.

Movement of the cylinders 24, 26 may cause the lip 20 to raise or to lower with respect to the bowl 2. FIG. 2A illustrates the lip 20 in a raised position. The cylinders 24, 26 may be extended to raise the lip 20. FIG. 2B illustrates a partial side view of the bowl 2 and the lip 20. By attaching the cylinders 24, 26 to the lip 20 on the sides 28, 30, and attaching the lip 20 to the bowl 2 at the points 29*a*, 29*b*, a maximum potential of the cylinders 24, 26 may be used when raising or lowering the lip 20. Accordingly, additional pins and/or settings for pins may not be required on each side 28, 30 of the lip 20 to maintain a position of the lip 20. In addition, less hydraulic fluid may be required for movement of the cylinders 24, 26.

Referring again to FIG. 3, an ejector plate 36 is illustrated which may be positioned at an end 38 of the bowl 2. The ejector plate 36 may be sized wherein a height 61 of the ejector plate 36 is substantially the same or greater than the height 23 of the bowl 2. A width 65 of the ejector plate 36 may be substantially the same or less than the width 27 of the bowl 2. In addition, a guard 7 may be attached to, or integrally formed with, the ejector plate 36. The guard 7 may be a planar wall and may extend vertically from the ejector plate 36. Further, the guard 7 may prevent materials accumulated within the bowl 2 from falling behind the ejector plate 36.

Figure 4:
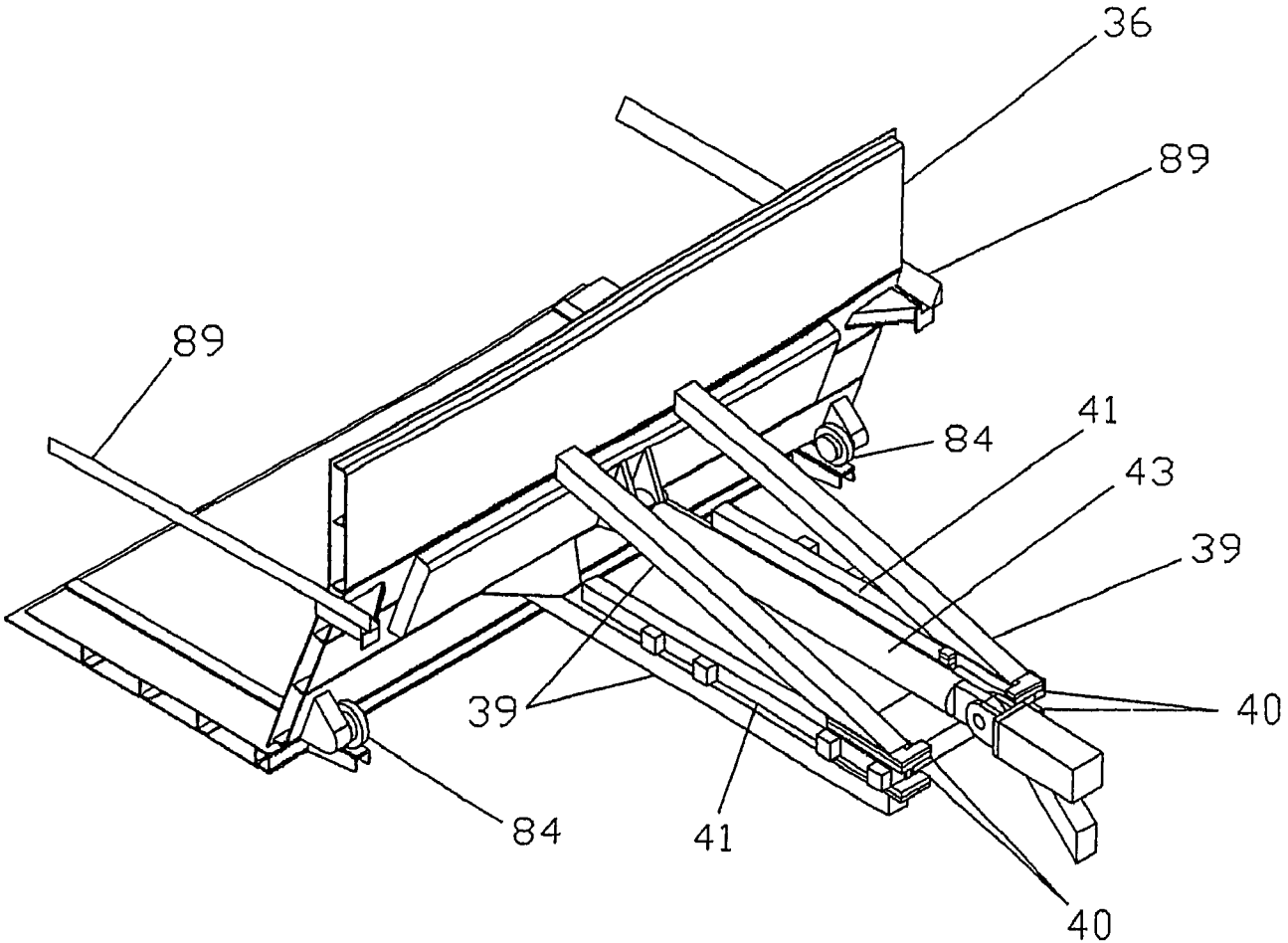
FIG. 4 illustrates an isolated perspective view of an ejector plate mechanism in an embodiment of the scraping device of FIG. 1.

The ejector plate 36 may be connected to a cylinder 43, as illustrated in FIG. 4. Wheels 84, or rollers, may also be connected to the ejector plate 36 to assist in moving the ejector plate 36. Movement of the cylinder 43 may cause the ejector plate 36 to be moved toward, or away from, the lip 20.

Figure 6:
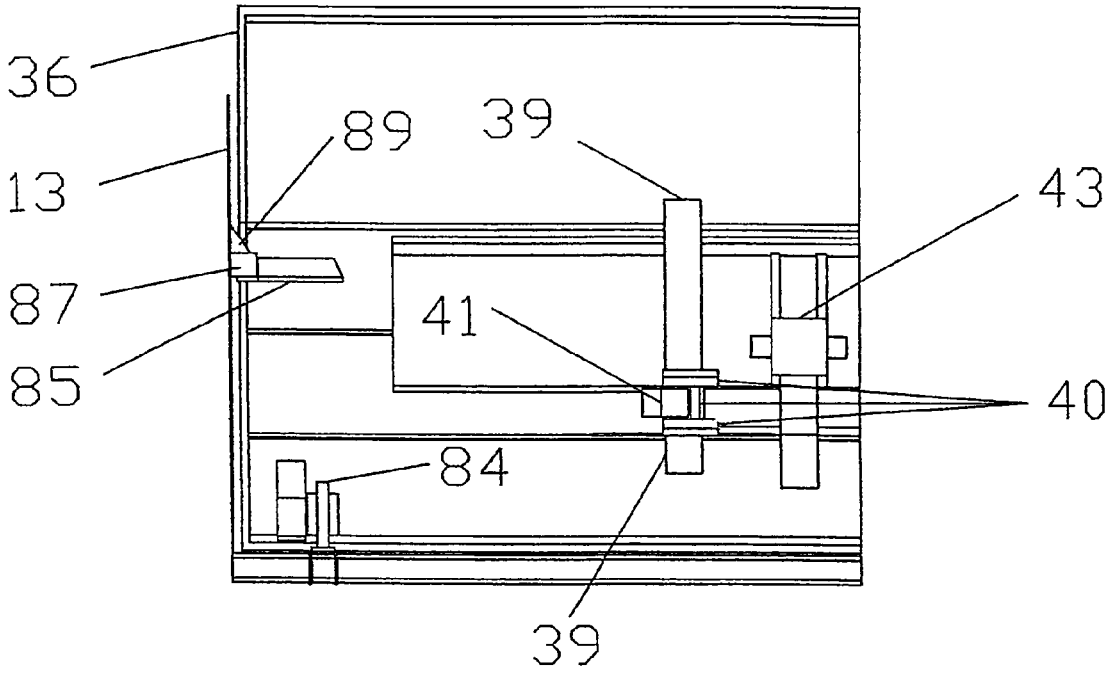
FIG. 6 illustrates a rear view of the ejector plate mechanism illustrated in FIG. 4.

FIG. 6 illustrates a rear view of the scraping device 1. The ejector plate 36 may be attached to beams 39 for supporting the ejector plate 36. Also attached to the ejector plate 36 may be a mounting bracket 85. Adjacent to the mounting bracket 85 may be a liner 87. In an embodiment, the liner 87 may be constructed from plastic. The liner 87 may reduce wear on a guide rail 89 attached to the wall 13 of the bowl 2 and/or the wall 13. The liner 87 may, therefore, reduce replacement costs for the guide rail 89 or the wall 13.

FIG. 6 also illustrates a liner 40 which may be positioned between the beams 39. The liner 40 may be constructed from, for example, plastic or like material. The liner 40 may contact a guide rail 41 and may prevent, for example, a metal-on-metal contact surface between the guide rail 41 and the beams 39. As a result, the liner 40 may reduce wear on the guide rail 41 and/or the beams 39.

Referring again to FIG. 3, the bowl 2 may be connected to a hitch 4 by a tongue 57. The hitch 4 may allow the scraping device 1 to be connected to a tractor (not shown) or other vehicle. The tractor may pull the scraping device 1 along an area, such as, for example, an area of grass or soil to be broken and/or collected. Wheels 80 may be associated with the scraping device 1 to enable the scraping device 1 to be transported.

Cylinders 12*a*, 12*b* may be pivotally connected to plates 14*a* and may be adjacent to the tongue 57 at ends 15*a* of the plates 14*a*. The cylinders 12*a*, 12*b* may also be connected to plates 14*b* at points 15*b*. The plates 14*b* may be attached to a tube 91 attached to the bowl 2. In addition, the plates 14*a* may be pivotally connected to the plates 14*b* at points 71 below the tongue 57. Accordingly, the plates 14*a*, 14*b* and cylinders 12*a*, 12*b* may provide, for example, a triangular shape.

Retraction of the cylinders 12*a*, 12*b* may cause the plates 14*a* to move closer to the plates 14*b*. In addition, the plates 14*a*, 14*b* may pivot at the points 71 below the tongue 57. The pivoting may cause the bowl 2 to be angled toward the area to be scraped wherein the blade 10 is positioned toward the area and may penetrate the area. Extension of the cylinders 12*a*, 12*b* may cause the plates 14*a* to move further from the plates 14*b*. The plates 14*a*, 14*b* may pivot at the points 71 and may cause the bowl 2 to be angled away from the area to be scraped wherein the blade 10 is moved away from the area.

The scraping device 1 may be connected to a tractor (not shown) and may be pulled across an area to collect materials within the bowl 2. To this end, the cylinders 12*a*, 12*b* may be retracted to angle the blade 10 toward the area. The cylinders 24, 26 may be moved to raise the lip 20. The opening is then exposed at the end 22 of the bowl 2, and materials may be collected through the opening. As the scraping device 1 is moved across the area, the blade 10 and/or the router bit 82 may slice into the area and may cause materials to be removed from the area. The removed materials may be collected at the end 38 of the bowl 2. After the materials have been collected, the cylinders 24, 26 may be moved to lower the lip 20 and prevent the collected materials from slipping from the bowl 2 through the opening at the end 22 of the bowl 2.

To dispose of the materials within the bowl 2, the cylinders 12*a*, 12*b* may be moved to angle the end 22 of the bowl 2 toward the ground. The lip 20 may be raised by movement of cylinders 24, 26. The cylinder 43 may then be moved to force the ejector plate 36 toward the lip 20. As the ejector plate 36 moves forward, the materials within the bowl 2 may be pushed by the ejector plate 36 through the opening within the bowl 2.

Figure 5:
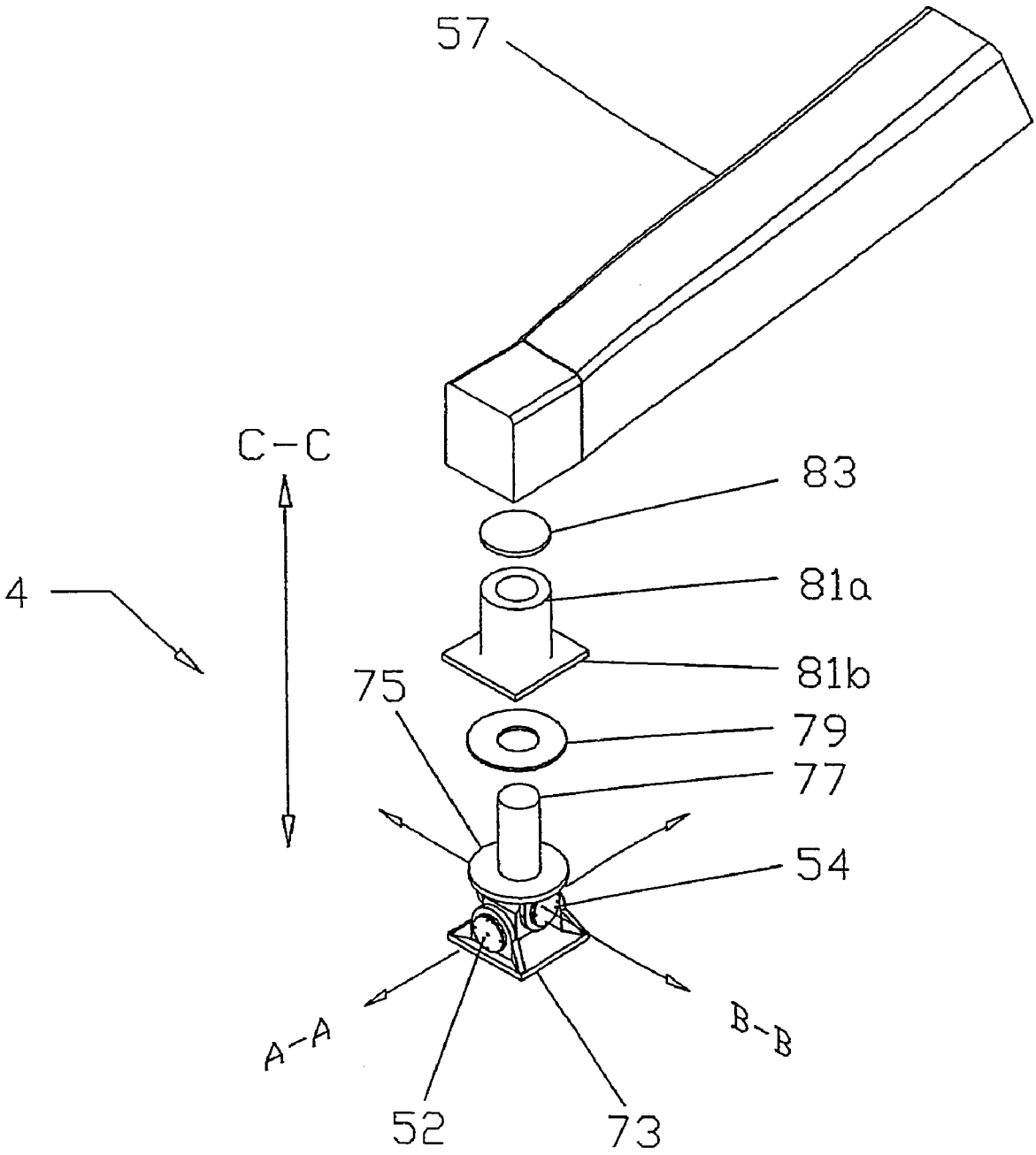
FIG. 5 illustrates an exploded view of an embodiment of a hitch implemented in the scraping device of FIG. 1.

Referring now to FIG. 5, an exploded view of the hitch 4 is illustrated. The hitch 4 may have a lower column 52 which may be aligned in a first direction as indicated by the line A-A. The lower column 52 may be attached to a base 73. Also attached to the lower column 52 may be an upper column 54 which may be aligned in a direction indicated by the line B-B. The line B-B may be perpendicular to the line A-A. The upper column 54 may be rotated around the lower column 52, or along the line A-A. The hitch 4 may also be rotated around an axis as indicated by the line B-B.

Attached to the upper column 54 may be a base 75 and a pillar 77. A liner 79 may be placed around the pillar 77. In an embodiment, the liner 79 may be constructed from, for example, plastic. A cover 81*a* may be provided over the pillar 77. A base plate 81*a* may be attached to the cover 81a. A cap 83 may be placed on the cover 81. The base plate 81*a* may be attached to the tongue 57. The connection between the tongue 57 and the pillar 77 may enable the hitch 4 to be rotated in a plane parallel to the lines A-A and B-B, or around an axis indicated by the line C-C.

The scraping device 1 may enable a user to collect materials in a cost-efficient manner. To this end, the positioning of the cylinders 24, 26 may allow raising/lowering of the lip 20 while utilizing a maximum potential of the cylinders 24, 26. As a result, less fluid is required to actuate the cylinders 24, 26. Further, the liner 40 placed between the beams 39, and/or the liner 87 placed adjacent to the guide rail 89, may prevent wear associated with metal-on-metal contact. The different axes of rotation within the hitch 4 may provide maneuverability and enable the scraping device 1 to be oriented into ideal positions for collection/removal of materials. The liner 79 placed within the hitch 4 may prevent, for example, a metal-on-metal interaction which may cause wear to the hitch 4. In addition, a tractor which may be attached to the hitch 4 may pull the scraping device 1 and may have a turning radius which may allow the scraping device 1 to be used in areas having shorter dimensions. Further, the triangular shape between the plates 14*a*, 14*b* and the cylinders 12*a*, 12*b* may enable the bowl 2 to be raised/lowered while utilizing a maximum potential of the cylinders 12*a*, 12*b*.

It should be understood that various changes and modifications to the presently preferred embodiments described herein will be apparent to those skilled in the art. Such changes and modifications may be made without departing from the spirit and scope of the present invention and without diminishing its attendant advantages.

I claim:

1. A scraping device comprising:

a frame having walls defining an interior and further having a length defined between a first end and a second end wherein the frame has a bottom surface that resides between the first end and the second end;

a wheel connected to the frame;

a plate at the first end of the frame;

a cylinder attached to the plate and the frame wherein movement of the cylinder causes the plate to move towards the second end of the frame;

beams connected to the plate wherein the beams are located between the plate and the first end;

guide rails connected to the interior of the frame wherein the guide rails are adjacent to the beams; and a liner positioned between the guide rails and the beams.

2. The scraping device of claim 1 further comprising:

a lip attached to the frame at the second end.

3. The scraping device of claim 1 further comprising:

a mounting bracket attached to the plate; and a liner positioned between the mounting bracket and a wall of the frame.

4. The scraping device of claim 1 further comprising:

a hitch attached to the frame.

5. The scraping device of claim 1 further comprising:

a blade attached at the second end of the frame.

6. A scraping device comprising:

a frame having walls defining an interior and further having a length defined between a first end and a second end;

a plate at the first end of the frame;

a cylinder attached to the plate wherein movement of the cylinder causes the plate to move towards the second end of the frame;

beams connected to the plate;

guide rails connected to the frame wherein the guide rails are adjacent to the beams;

a liner positioned between the guide rails and the beams; and a lip attached to the frame at the second end.

7. A scraping device comprising:

a frame having walls defining an interior and further having a length defined between a first end and a second end;

a plate at the first end of the frame;

a cylinder attached to the plate wherein movement of the cylinder causes the plate to move towards the second end of the frame;

beams connected to the plate;

guide rails connected to the frame wherein the guide rails are adjacent to the beams;

a liner positioned between the guide rails and the beams;

a mounting bracket attached to the plate; and a liner positioned between the mounting bracket and a wall of the frame.

8. A scraping device comprising:

a frame having walls defining an interior and further having a length defined between a first end and a second end;

a plate at the first end of the frame;

a cylinder attached to the plate wherein movement of the cylinder causes the plate to move towards the second end of the frame;

beams connected to the plate;

guide rails connected to the frame wherein the guide rails are adjacent to the beams;

a liner positioned between the guide rails and the beams; and a hitch attached to the frame.

9. A scraping device comprising:

a frame having walls defining an interior and further having a length defined between a first end and a second end;

a plate at the first end of the frame;

a cylinder attached to the plate wherein movement of the cylinder causes the plate to move towards the second end of the frame;

beams connected to the plate;

guide rails connected to the frame wherein the guide rails are adjacent to the beams;

a liner positioned between the guide rails and the beams; and a blade attached at the second end of the frame.

* * * * *